US012799765B2

(12) United States Patent
Cannon

(10) Patent No.: US 12,799,765 B2
(45) Date of Patent: Nov. 17, 2026

(54) SYSTEM AND METHOD FOR INSTALLING POSTS VERTICALLY IN FORM OR HOLE

(71) Applicant: INNOVATE ON SITE SOLUTIONS INC., Waterford (CA)

(72) Inventor: Mark Joseph Cannon, Waterford (CA)

(73) Assignee: INNOVATE ON SITE SOLUTIONS INC., Waterford (CA)

( * ) Notice: Subject to any disclaimer, the term of this patent is extended or adjusted under 35 U.S.C. 154(b) by 141 days.

(21) Appl. No.: 18/740,229

(22) Filed: Jun. 11, 2024

(65) Prior Publication Data

US 2025/0376867 A1 Dec. 11, 2025

(51) Int. Cl.
*E04H 12/34* (2006.01)
*E02D 5/74* (2006.01)
(Continued)

(52) U.S. Cl.
CPC ..... *E04H 12/347* (2013.01); *E02D 5/74* (2013.01); *E04H 12/04* (2013.01);
(Continued)

(58) Field of Classification Search
CPC ..... E02D 5/74; E04H 12/04; E04H 12/2269; E04H 12/347; E04H 12/2284; E04H 17/009; E04H 17/22; E04H 17/263
See application file for complete search history.

(56) References Cited

U.S. PATENT DOCUMENTS 4,438,896 A * 3/1984 Hall ..... F16M 11/16 248/168
5,002,252 A * 3/1991 Setala ..... A47G 33/12 248/533
(Continued)

FOREIGN PATENT DOCUMENTS

CN 208965576 U 6/2019
CN 111364827 A * 7/2020 ..... E04H 12/2284
(Continued)

OTHER PUBLICATIONS

Bigfoot Systems—The Original, Bigfoot Systems, Copyright 2008-2024, https://www.bigfootsystems.com/include/projects.htm, last accessed Oct. 8, 2024.
(Continued)

*Primary Examiner* — Jessie T Fonseca
(74) *Attorney, Agent, or Firm* — Ryan T. Grace; Advent, LLP

(57) ABSTRACT

A support system and method for securing vertical centered placement of various nominally sized wooden posts within a cylindrical form within the soil or within a cylindrical hole alone comprises a plurality of spaced apart adjustable post support braces formed from a plurality of radial support braces. The radial support braces each have a first component that has a body section configured for attaching the first component to a wooden post. Each radial support brace has a second component that has a first section configured for supporting the second end of the first section in abutment against a peripheral inner wall of the form or hole and configured to cooperate with the second end of the first component to permit longitudinal movement of the first and second components. Each radial support brace is further configured to lock the first component in position relative to the second component.

11 Claims, 13 Drawing Sheets

(51) Int. Cl.

| | |
|---|---|
| ***E04H 12/04*** | (2006.01) |
| ***E04H 12/22*** | (2006.01) |
| ***E04H 17/00*** | (2006.01) |
| ***E04H 17/22*** | (2006.01) |
| ***E04H 17/26*** | (2006.01) |

(52) U.S. Cl.
CPC ..... *E04H 12/2269* (2013.01); *E04H 17/009* (2021.01); *E04H 17/22* (2013.01); *E04H 17/263* (2013.01)

(56) References Cited

U.S. PATENT DOCUMENTS

| | | | | |
|---|---|---|---|---|
| 5,133,164 | A | 7/1992 | Legler | |
| 6,419,201 | B1 * | 7/2002 | Hughes, Jr. | F16M 11/242 248/514 |
| 7,942,612 | B1 | 5/2011 | Willison | |
| 8,991,777 | B2 * | 3/2015 | Madril | E04H 12/2284 52/127.2 |
| 10,559,231 | B2 * | 2/2020 | Kyle | G09F 7/18 |
| 10,745,931 | B1 * | 8/2020 | Gathers | E04H 12/2269 |
| 11,124,934 | B2 | 9/2021 | Beason et al. | |
| 11,208,824 | B1 * | 12/2021 | Kemmsies | B66F 3/12 |
| 12,044,025 | B1 * | 7/2024 | Radhs | E04H 12/2284 |
| 2009/0090527 | A1 * | 4/2009 | Wilson | E04H 17/263 173/90 |
| 2009/0090836 | A1 * | 4/2009 | Harris | E04H 12/2215 248/545 |
| 2014/0373461 | A1 * | 12/2014 | Rodriguez | E04H 17/263 52/297 |
| 2015/0108318 | A1 * | 4/2015 | Orr | E04H 12/2284 248/523 |
| 2016/0029827 | A1 * | 2/2016 | Finnin, Jr. | A47G 33/1213 248/524 |
| 2016/0138297 | A1 | 5/2016 | Gibbs et al. | |
| 2018/0230664 | A1 * | 8/2018 | Dominguez | E02D 5/54 |
| 2024/0401368 | A1 * | 12/2024 | Figueroa | E04H 12/2238 |

FOREIGN PATENT DOCUMENTS

| | | | |
|---|---|---|---|
| CN | 112610025 | A | 4/2021 |
| GB | 2456761 | A | 7/2009 |

OTHER PUBLICATIONS

"FootingPad Light Weight Footers," Engineered Building Solutions, LLC, Copyright 2022, https://www.ebsmanufacturing.com/footingpad-footers-for-post-frame-construction/, last accessed Oct. 8, 2024.

* cited by examiner

SYSTEM AND METHOD FOR INSTALLING POSTS VERTICALLY IN FORM OR HOLE

The present invention generally relates to a system and method to improve upon current methods of installing vertical posts in a cylindrical form within a cylindrical excavation in the ground or within the excavation alone. The invention disclosed is designed to address the securing of a nominally sized wooden post from unwanted linear, lateral, or plumb vertical movement prior to and during the process of pouring concrete, foam or other suitable aggregate or backfill to permanently encase the posts.

BACKGROUND OF THE INVENTION

For several decades the permanent placement of nominally sized posts has been used for the purpose of—but not exclusive to—providing permanent concrete encased, structurally sound, plumb vertical support posts for constructing fences, decks, and gazebos.

Typically, when building a wooden fence for example, stakes are used to identify the corners of the proposed fence. A string is run between the stakes providing a plumb line to ensure the holes and ultimately the fence posts are in a straight line from one end to another. The face of each post should align with the string, all on the same side.

During the construction process the portion of the posts above grade are temporarily braced with various materials and methods with the intended purpose of keeping the entirety of the post, including the portion below grade from shifting—prior to and during the process of pouring concrete to encase the post. Wooden stakes are driven into the ground around the excavation to supply an anchor for the eventual necessity of vertical, lateral, and/or linear wooden braces. The braces are temporarily attached to the intermediate and upper portions of the posts on approximate 30 to 45° angles back to their stakes/anchors, which are placed perpendicular to and in line (90°) to the intended linear placement of all posts with the intended goal of keeping the posts secured, centered, and plumb in an attempt to eliminate movement while pouring concrete to encase the posts.

This process is cumbersome and costly with the extra needed material to act as braces and physical labour to install them. Further bracing the section of the post above grade does not affirm bracing of the section of the post in the form or hole.

A post hole shoring apparatus is illustrated in U.S. Pat. No. 7,942,612, but it does not eliminate or reduce the need for above ground bracing. The post hole shoring apparatus only secures the bottom end of the post without providing any bracing at intermediate positions within the excavation, which will ultimately affect the secured vertical plumb and lateral placement of the posts during the process of pouring concrete.

A bollard assembly with stress control device is illustrated in U.S. Pat. No. 11,124,934, It is designed for round posts composed of various materials. It however does not address the intermediate support of a vertical nominally sized post to keep secured prior to and during the process of pouring concrete to encase the post.

Rapid setting concrete such as SAKRETE™ RAPID POST and foam fence post backfill products such as FAST 2K™ fence post backfill or SIKA™ POST FIX, while offer rapid cure times, still require the securing of structural posts prior to encasing them in concrete or foam.

The present invention addresses the problems of these known apparatus and methods and is intended to eliminate or the need to provide and install wood braces to the portion of the post above grade.

SUMMARY OF THE INVENTION

This invention pertains to the use of posts as part of a structural vertical support system for the construction of various projects such as—but not limited to—fences, decks, and gazebos. The process for fences, as an example, is typically achieved by linear, transitional placement of posts in the earth, excavated to the point indicated by national and local municipalities building codes to stay below frost level, where applicable, based for permanent and optimum structural support. The invention disclosed within is directly related to the improvement of the methodology of the process of securing of structural posts prior to encasing them in concrete, foam or other suitable aggregate. The method disclosed herein provides lateral support preferably in at least two spaced apart locations within the surrounding form or excavation to provide, linear, lateral, and plumb vertical integrity of the posts. The apparatus disclosed herein remains within the cylindrical form or excavation permanently attached to the posts and encased in concrete, foam or other suitable aggregate with the post, providing increased stability and no interference to the overall structure of the buried posts.

In one embodiment the present invention provides a radial support brace for use with a support system for wooden posts having one end to be permanently encased by concrete, foam or other suitable aggregate in a cylindrical form within a cylindrical hole or in a cylindrical hole in the ground without the use of a form, the radial support brace comprising a. a first component that has
   (i) a body section having top and bottom surfaces, opposing sides and first and second ends;
   (ii) means at a first end of the body section to attach the first component to a wooden post,
b. a second component that has
   (i) a first section having a top surface, opposing sides and first and second ends;
   (ii) means at a second end of the first section to support the second end of the first section in abutment against a peripheral inner wall of the form or hole;
   (iii) means at a first end of the first section to cooperate with means at the second end of the first component to permit longitudinal movement of the first and second components;
c. means to lock the first component in position relative to the second component.

A plurality of the radial support braces are utilized to form an adjustable post support brace and spaced apart adjustable post support braces provide a support system for wooden posts having one end to be permanently encased in concrete, foam or other suitable aggregate in a cylindrical form within hole in the ground or in a cylindrical hole in the ground without the use of a form. The support system if installed properly is intended to secure the post in a desired position prior to and during the process of encasing the wooden post.

In a preferred embodiment of the invention in so far as it relates to the design of the radial support braces, the present disclosure teaches a radial support brace where the means to attach the first component to a wooden post is a base plate perpendicular to the longitudinal axis of the first component adapted for connection to a side of the wooden post. Further the second end of the first section of the second component has an opening sized and shaped to permit a circular outer ring to pass through the opening and permit the radial support brace to move around said outer ring while extending radially inwardly from the outer ring. The outer ring is sized and shaped so that it can be adjusted to accommodate variably sized pre-manufactured cylindrical forms or cylindrical holes. In one embodiment the outer ring is formed from a strap having inner and outer surfaces, top and bottom longitudinal edges, a first end and a second end. The strap wraps around itself to form the circular outer ring and has means to adjust the diameter of the outer ring. One means to adjust the diameter of the outer ring is to provide a plurality of slots traverse to the longitudinal axis of the strap, sized and shaped to accept a set pin on the inner surface at one end of the of the strap so that it can be pressed into the appropriate slot to set the diameter of the outer ring.

To permit longitudinal movement of the first and second components of the radial support brace of the preferred embodiment a rod section extends from a first end of the first section of the second component and is sized and shaped to fit within a longitudinal channel in the second end of the first component. While the preferred embodiment illustrated has the rod section extending from a first end of the first section of the second component sized and shaped to fit within a longitudinal channel in the second end of the first component, the design of the first and second sections can be reversed so a rod section extending from a second end of the first component is sized and shaped to fit within a longitudinal channel in the first end of the first section of the second component.

Another aspect of the present invention discloses an improved method of installing a wooden post having one end to be permanently encased by concrete, foam or other suitable aggregate in a cylindrical form within a cylindrical excavation or in a cylindrical excavation in the ground without the use of a form where the post is secured prior to and during the process of encasing the end of the wooden post. The method comprises the steps:

a. adjusting and locking the diameter of the circular adjustable outer ring of a first adjustable post support brace to the size of the cylindrical form or cylindrical excavation;
b. moving the radial support braces along the circular outer ring and attaching the first adjustable post support brace adjacent to a lower end of a wooden post to be inserted into the form within a cylindrical hole or in the cylindrical hole in the ground;
c. optionally locking the first component of each radial brace in position relative to the second component of the radial brace;
d. adjusting and locking the diameter of the circular adjustable outer ring of a second adjustable post support brace to the size of the cylindrical form or cylindrical hole;
e. moving the radial support braces along the circular outer ring and attaching the second adjustable post support brace to the end of the wooden post to be inserted into the form or in the cylindrical excavation in the ground, wherein the second adjustable post support brace is spaced apart from the first adjustable post support brace;
f. optionally locking the first component of each radial brace on the second adjustable post support in position relative to the second component of the radial brace;
g. inserting the end of the wooden post having the spaced apart adjustable post supports into the form or cylindrical hole in the ground;
h. if required to have the wooden post in a desired linear, lateral, and plumb, vertical position, sequentially unlock, if necessary, the first component of opposing radial braces of each spaced apart post support brace and move the wooden post to the desired position then lock the first component of each of the opposing radial braces in position and repeat for the other set of radial braces so the wooden post is secured prior to and during the process of encasing the portion of the post in the form or hole in the ground with concrete, foam or other suitable aggregate.

BRIEF DESCRIPTION OF THE DRAWINGS

In order that the invention may be more clearly understood, embodiments thereof will now be described in detail by way of example, with reference to the accompanying drawings, in which.

DETAILED DESCRIPTION OF THE INVENTION

Figure 1:
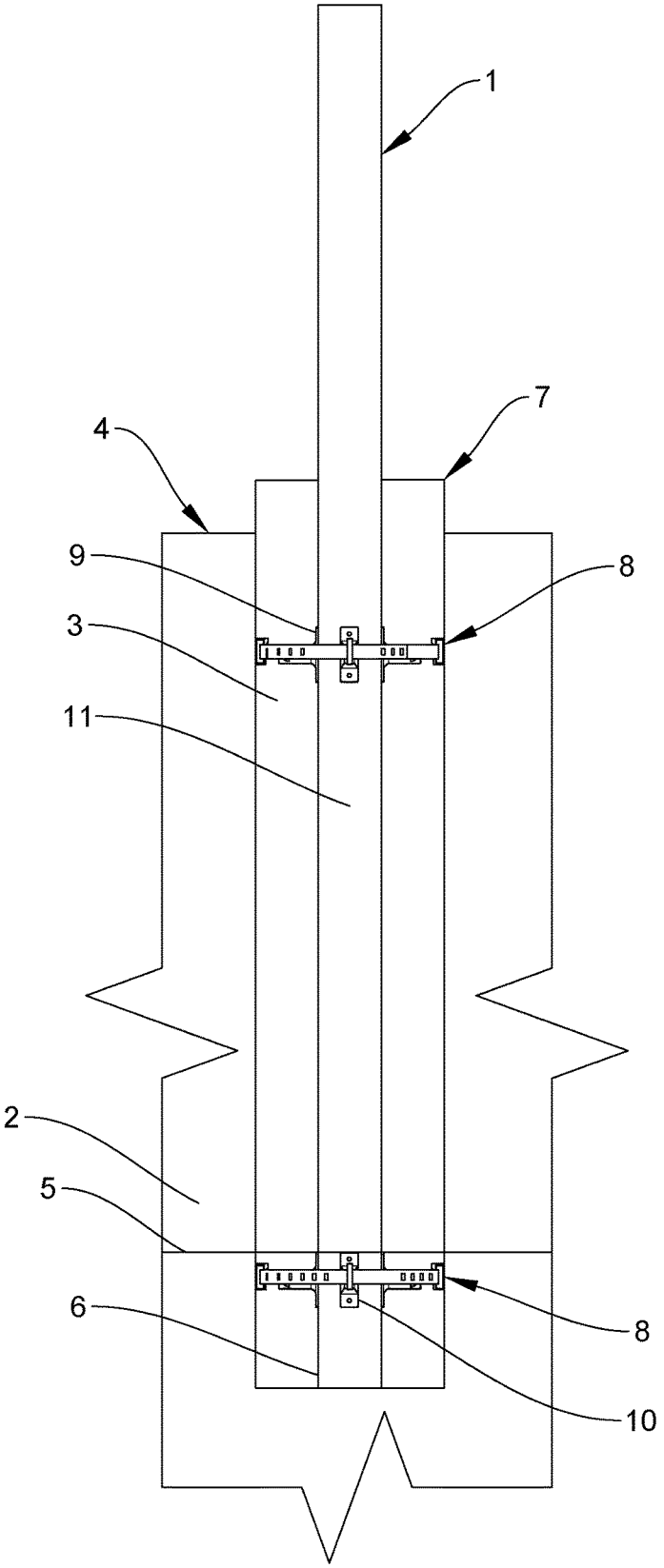
FIG. 1 is a schematic view in cross section of a wooden post in a hole with a pair of post support braces attached to the wooden post in accordance with one embodiment of the present invention.

Having regard to FIG. 1, a schematic cross section of a wooden post in a hole is illustrated. When installing nominally sized wooden posts, generally indicated at 1, vertically into the soil 2, the hole or excavation 3 needs to be deep enough from grade 4 to be below the frost line 5. The actual frost line depth changes depending on the location, soil content, moisture content, and average temperatures throughout the year. The exact required below frost line depth or depth of the hole below grade from local building codes should be researched before planning a project. Local codes, frost depths aside, may provide the post should be placed with a proportional percentage in the ground relative to the portion above grade to maintain structural balance-see local building codes. One end 6 of the wooden post 1 is place in the hole 3 typically inside a cylindrical concrete form 7 within the hole or excavation 3. The end 6 of the wooden post 1 can be placed in the hole or excavation 3 without the use of a form (not shown). In the case of fence posts, typically 60% or more of the post remains above grade 4. The post needs to be braced to control or minimize movement of the end 6 of the wooden post 1 in the hole 3 during the process of pouring concrete, foam or other suitable aggregate or backfill into the cylindrical form or in the cylindrical hole alone.

Figure 2:
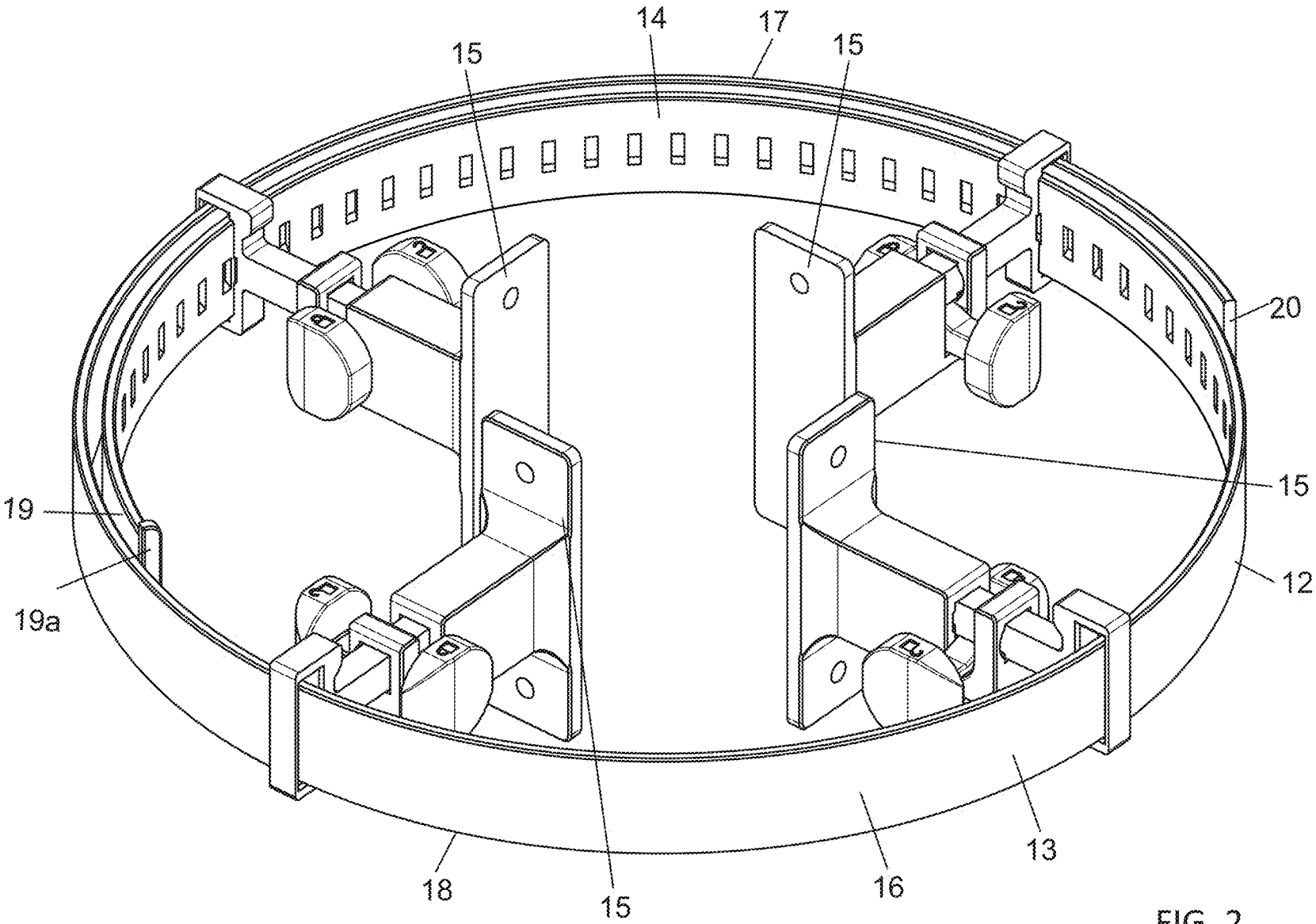
FIG. 2 is a perspective view of one embodiment of a post support brace according to the present invention having an outer ring and a plurality of radial support braces.
Figure 3:
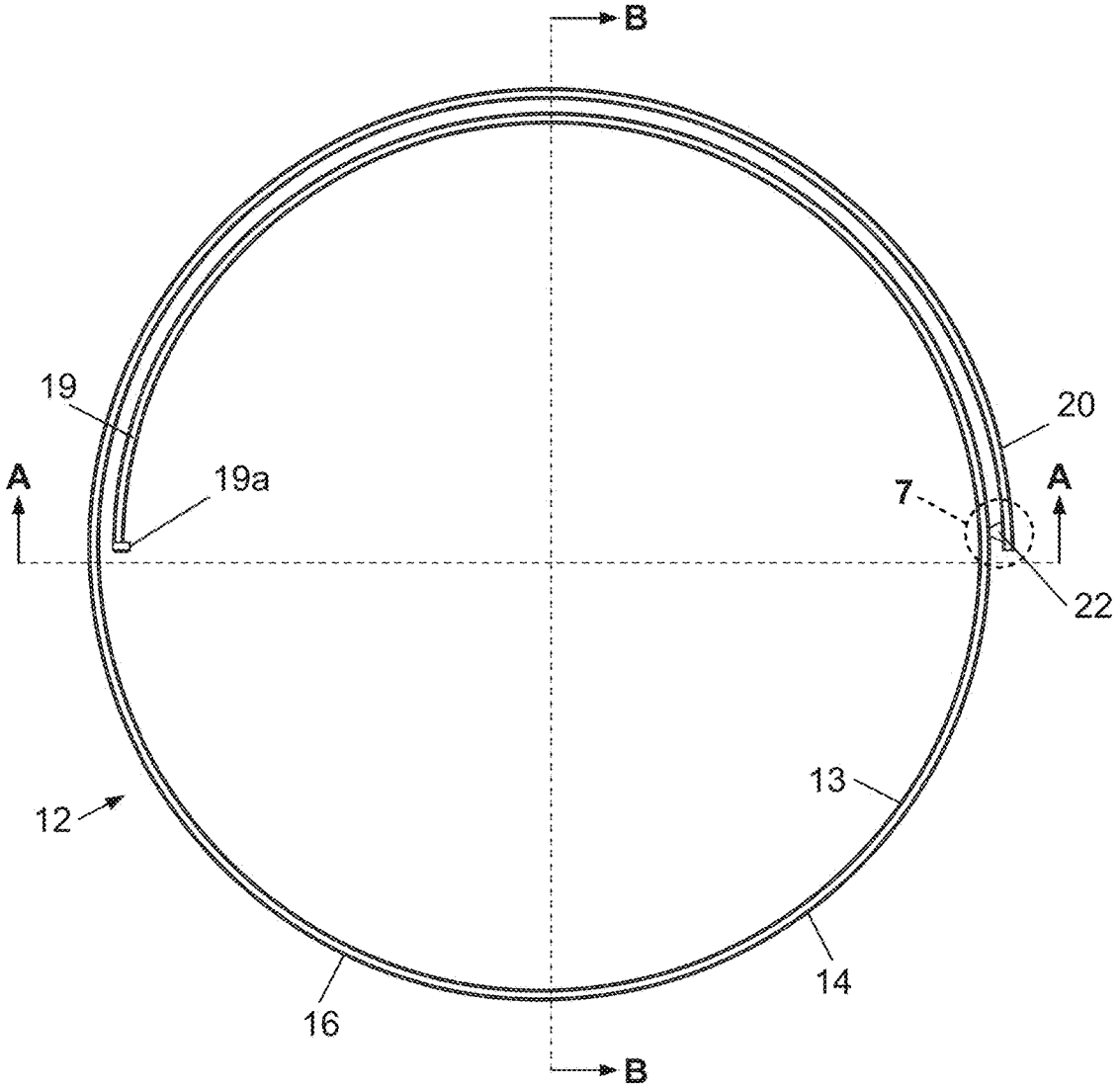
FIG. 3 is top plan view of the outer ring of the post support brace of FIG. 2.
Figure 4:
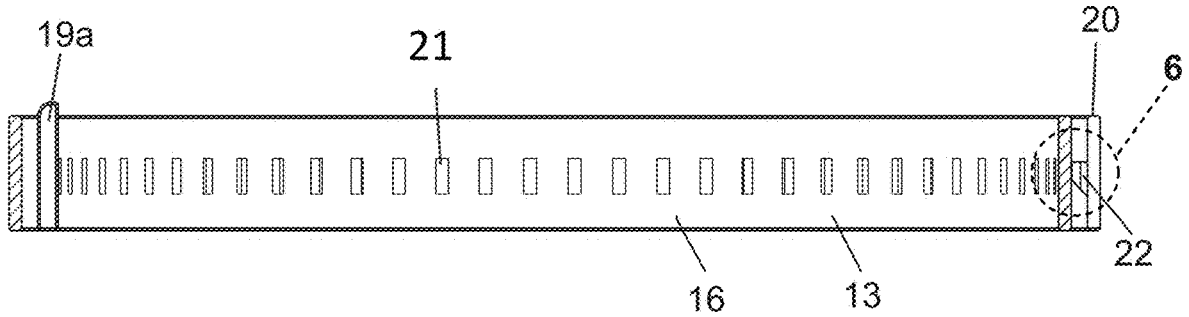
FIG. 4 is a plan view in cross section of the outer ring of FIG. 3 thru line A-A.
Figure 5:
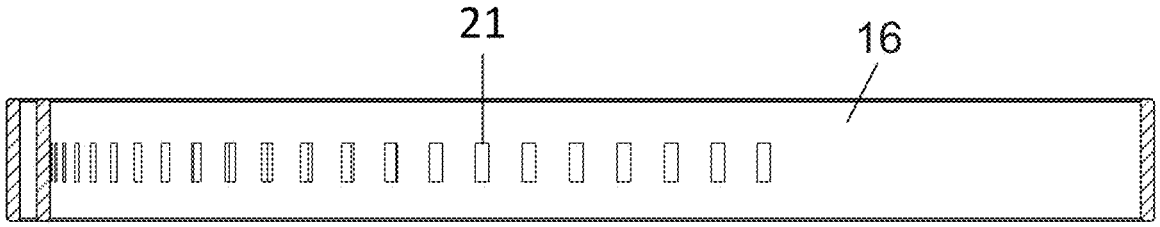
FIG. 5 is a plan view in cross section of the outer ring of FIG. 3 thru line B-B.
Figure 6:
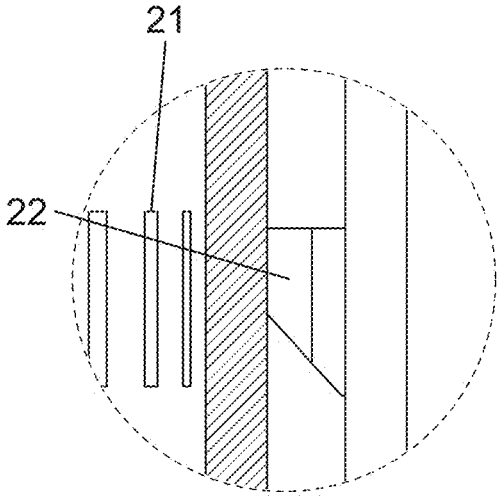
FIG. 6 is an enlarged side plan view of the outer ring and set pin at circle 6 in FIG. 4.
Figure 7:
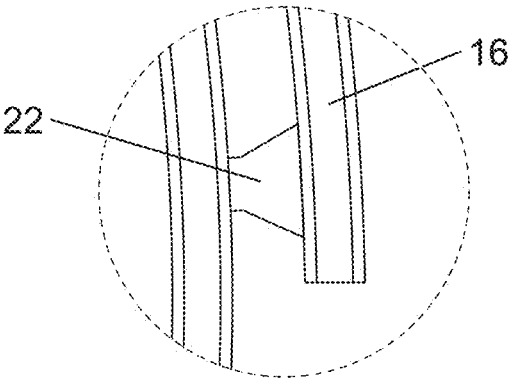
FIG. 7 is an enlarged top plan view of the outer ring and set pin at circle 7 in FIG. 3.
Figure 8:
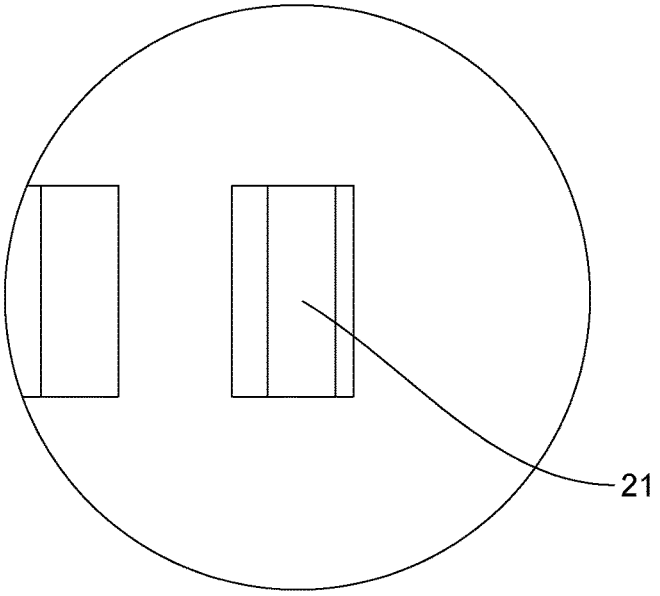
FIG. 8 is an enlarged front plan view of the outer ring and a diameter adjustment receiving slot.
Figure 9:
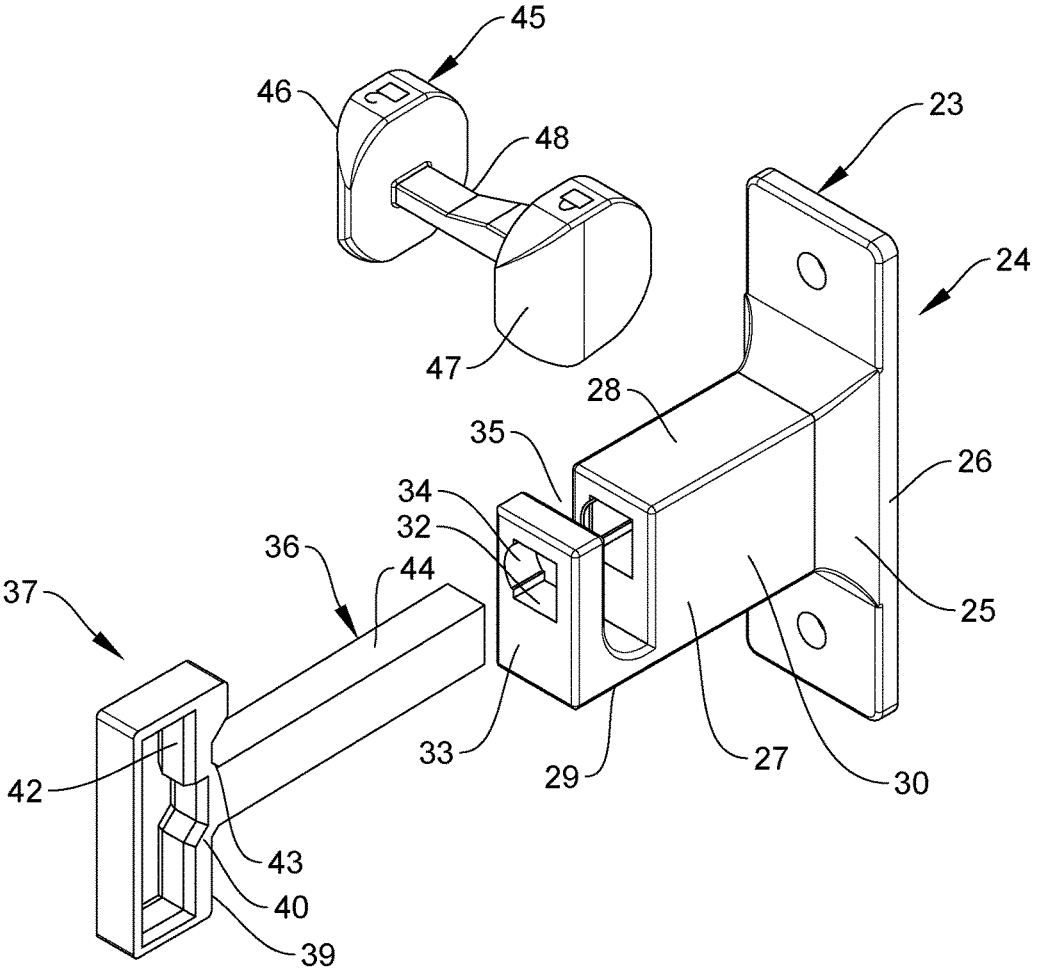
FIG. 9 is a perspective view of the first and second components and locking pin of the radial brace shown FIG. 2.
Figure 10:
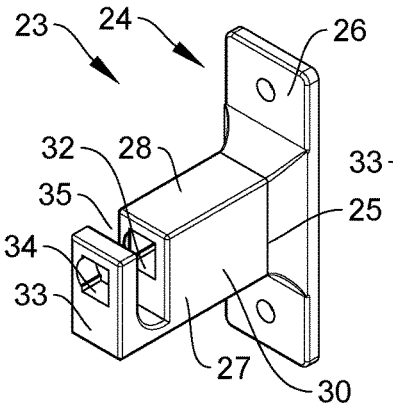
FIG. 10 is a perspective view of the first component of the radial brace of FIG. 9.
Figure 11:
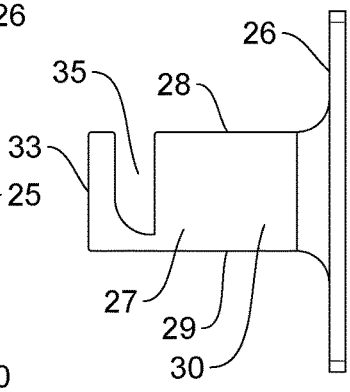
FIG. 11 is a side elevation of the first component of FIG. 10.
Figure 12:
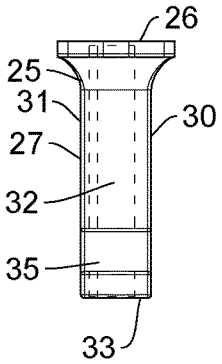
FIG. 12 is a top plan view of the first component of FIG. 11.
Figure 13:
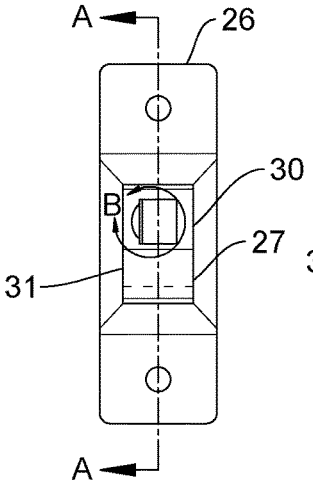
FIG. 13 is a left end plan view of the first component of FIG. 10.
Figure 14:
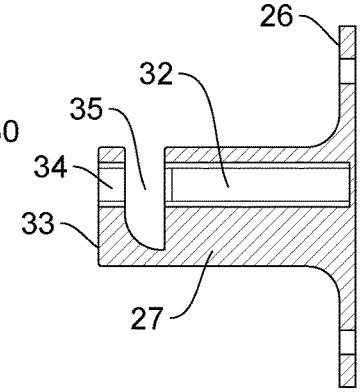
FIG. 14 is a plan view in cross section of the first component of FIG. 13 thru line A-A.
Figure 15:
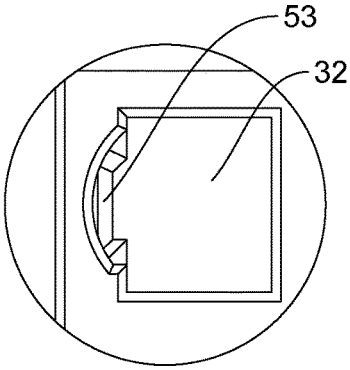
FIG. 15 is a detailed left end plan view of the first component at circle B in FIG. 13.
Figure 16:
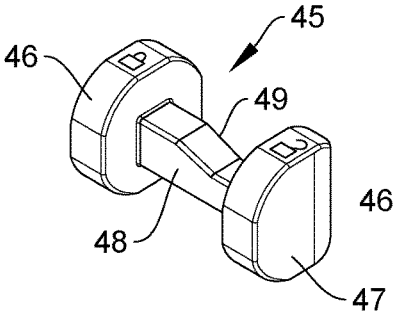
FIG. 16 is a perspective view of the locking pin of the radial brace of FIG. 9.
Figure 17:
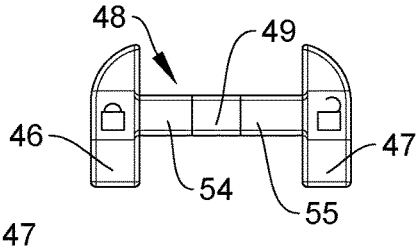
FIG. 17 is a top plan view of the locking pin of FIG. 16.
Figure 18:
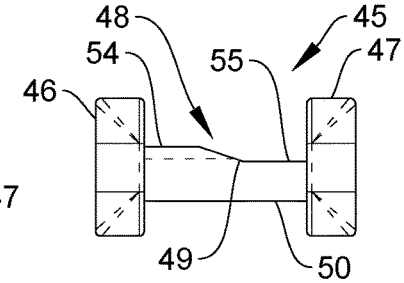
FIG. 18 is a front plan view of the locking pin of FIG. 16.
Figure 19:
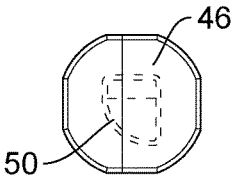
FIG. 19 is a plan view of the left end plate of the locking pin of FIG. 16.
Figure 20:
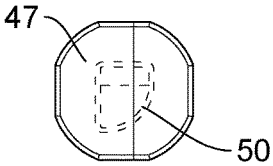
FIG. 20 is a plan view of the right end plate of the locking pin of FIG. 16.
Figure 21:
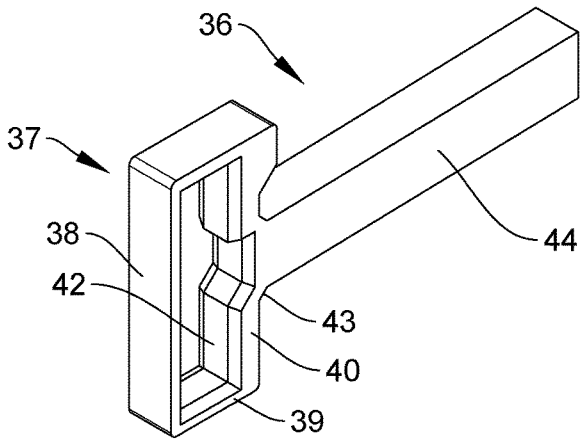
FIG. 21 is a perspective view of the second component of the radial brace of FIG. 9.
Figure 22:
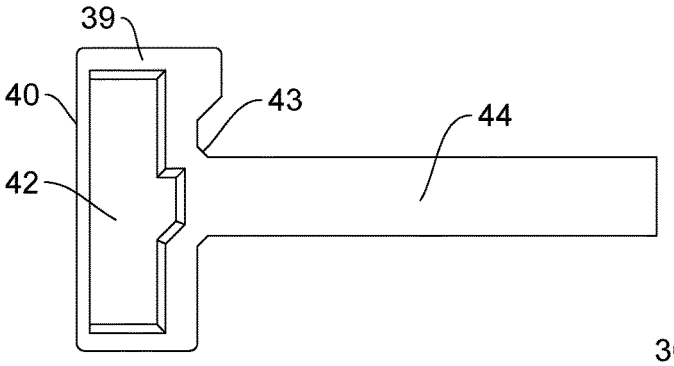
FIG. 22 is a front side elevation of the second component of FIG. 21.
Figure 23:
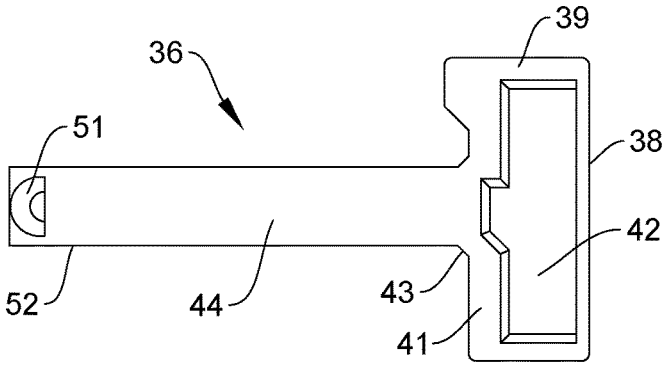
FIG. 23 is a back side elevation of the second component of FIG. 21.
Figure 24:
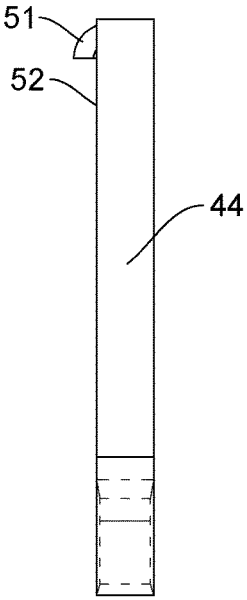
FIG. 24 is a top plan view of the second component of FIG. 21.

As shown in FIGS. 1, 2 and 3, in accordance with one embodiment of the present invention, a pair of post support braces generally indicated at 8, are attached at spaced apart locations, 9, 10, on the portion 11 of the wooden post 1 that will be inserted into the hole 3. Each post support brace 8 comprises an outer ring 12 having inner and outer surfaces 13, 14 and a plurality of radial support braces, generally indicated at 15.

In the embodiment illustrated the outer ring 12 is sized and shaped so that it can be adjusted to accommodate variably sized pre-manufactured cylindrical forms or equally shaped cylindrical holes. The cylindrical forms are usually from 9½ inches to 12½ inches in diameter which can accommodate 4×4 to 6×6 wooden posts. In the embodiment illustrated, the outer ring 12 is formed from a strap 16 having inner and outer surfaces 13, 14, top and bottom longitudinal edges 17, 18, a first end 19 and a second end 20. In the embodiment illustrated the strap 16 wraps around itself to form the circular outer ring 12 and has means to adjust the diameter of the outer ring 12. In this embodiment, the means to adjust the diameter of outer ring 12 is a plurality of slots 21 traverse to the longitudinal axis of strap 16 sized and shaped to accept a set pin 22 formed on the inner surface 13 of the second end 20 of strap 16. Strap 16 is adjusted to a desired diameter as shown in FIG. 2 then set pin 22 is pushed into the appropriate slot 21. In the embodiment illustrated the slots 21 are placed for a distance of about 33% of the total circumference of strap 16 from the first end 19. The set pin 22 is held in by friction between the set pin 22 and the receiving slot 21 and additionally by the bias force of the strap 16 when wrapped around itself in a circle.

In the embodiment illustrated in FIG. 2, 9-27 the plurality of radial support braces, generally indicated at 15, each have a:

a. first component that has:
   (i) a body section having top and bottom surfaces, opposing sides and first and second ends;
   (ii) means at a first end of the body section to attach the first component to a wooden post,
b. a second component that has:
   (i) a first section having a top surface, opposing sides and first and second ends;
   (ii) means at a second end of the first section to support the second end of the first section in abutment against a peripheral inner wall of the form or hole;
   (iii) means at a first end of the first section to cooperate with means at the second end of the first component to permit longitudinal movement of the first and second components;
c. means to lock the first component in position relative to the second component.

In the embodiment illustrated, first component 23 has means, generally indicated at 24, at a first end 25 of component 23 to attach component 23 to the wooden post 1. In the embodiment illustrated means 24 is a base plate 26 perpendicular to the longitudinal axis of the first component 23. Component 23 in the embodiment illustrated in FIG. 9 has a body section 27 having top 28 and bottom 29 surfaces and opposing sides 30, 31. A channel 32 extends longitudinal through body section 27 from a second end 33 of body section 27. Channel 32 has an open end 34 at the second end 33 of body section 27. A downward vertical slot 35 extends from the top surface 28 of body section 27.

Each of the plurality of radial support braces, generally indicated at 15, in the embodiment illustrated in FIGS. 2, 9-27 further include a second component 36 that has means, generally indicated at 37, at a first end 38 of component 36 to attach component 36 to the outer ring 12. In the embodiment illustrated means 37 is a rectangular section 39 having sides 40, 41 with a centrally disposed opening 42 extending through sides 40, 41. The shape of section 39 can vary without departing from the scope of the present invention. The opening 42 is sized and shaped to permit the strap 16 of outer ring 12 to pass through the opening 42 and allow the radial braces 15 to slide along strap 16 while extending inwardly from outer ring 12. Extending from an end 43 of the rectangular section 39 is a rod section 44 sized and shaped to slide within channel 32 of the first component 23 of the radial brace 15. The position of the rod section 44 within channel 32 is lockable in position with a tapered sliding lock pin 45 illustrated in FIG. 11 and FIGS. 18-22. The locking pin 45 has a pair of end plates 46, 47 connected by a rod 48, the rod 48 having top 49 and bottom surfaces 50. Rod 48 is sized and shaped to slide perpendicularly within vertical slot 35 in first component 23 beneath the rod section 44 sliding in channel 32. The top surface 49 is tapered from a thicker portion 54 of rod 48 adjacent end plate 46 to the portion 55 of rod 48 adjacent end plate 47 so that when locking pin 45 is pushed from an unlocked position to a locked position rod section 42 of the second component 36 is locked in position against the walls of channel 32 in first component 23.

Figure 25:
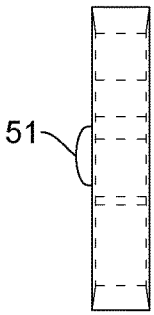
FIG. 25 is a left end plan view of the second component of FIG. 21.
Figure 26:
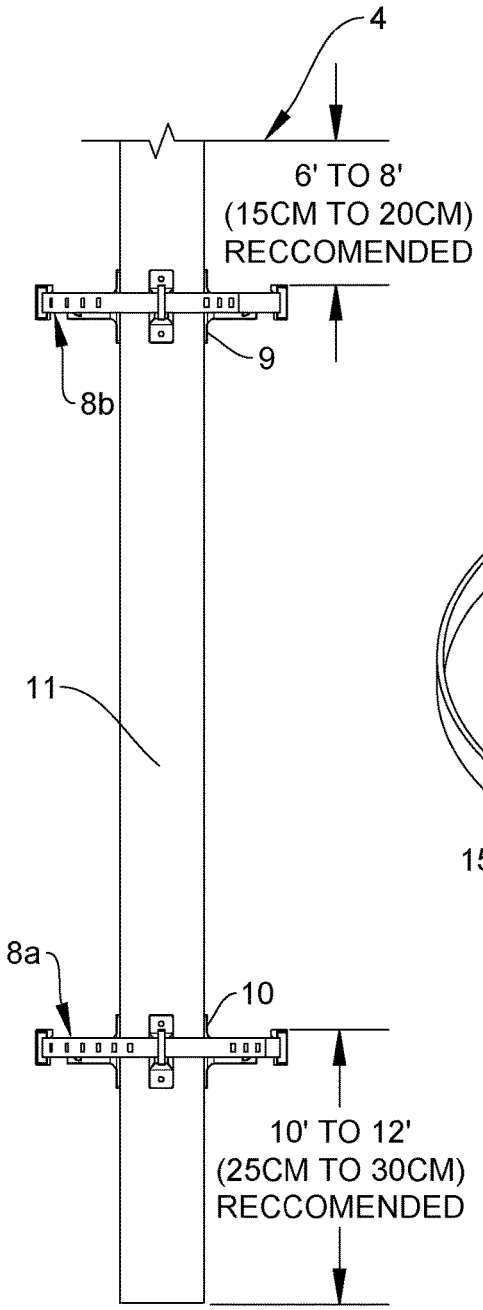
FIG. 26 is a schematic plan view of a pair of post support braces of FIG. 2 attached to a 4"×4" wooden post.
Figure 27:
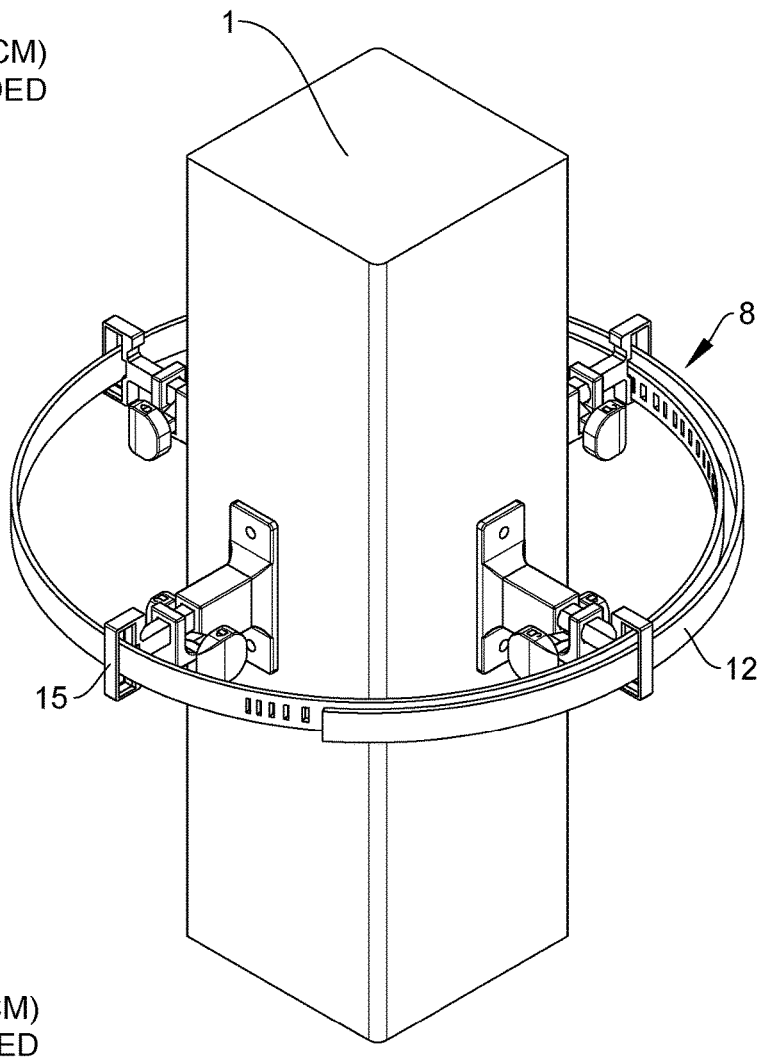
FIG. 27 is an enlarged perspective view of one of the post support brace of FIG. 26 attached to a 4"×4" post.

As best illustrated in FIGS. 25 and 26 the rod section 44 of the second component 36 has means to align rod section 44 within channel 32 and prevent it from rotating. The means used in this embodiment is a button 51 located at the end 52 of rod section 44 that extends into channel 32. Button 51 slides along a slot 53 in channel 32.

The design of the radial support braces 15 can be reversed from the design illustrated, so the channel is formed on the second component 136 and a rod section on the first component 23 slides within the channel on the second component.

The embodiment illustrated shows a support system for wooden posts having one end to be permanently encased in concrete, foam or other suitable aggregate in a cylindrical form within an excavation in the ground or in a cylindrical excavation in the ground without the use of a form. The support system securing the post prior to and during the process of encasing the wooden post, comprises a plurality of spaced apart adjustable post support braces formed from a plurality of radial support braces in accordance the disclosure herein.

The support system for wooden posts illustrated in FIGS. 1 and 26 shows a pair of spaced apart adjustable post support braces 8*a*, 8*b* formed from four radial support braces 15 as illustrated in FIGS. 2-27. To assemble the radial support braces 15 on strap 16, the end 20 of strap 16 with the set pin 22 is fed through opening 42 on the second component 36 of each radial support brace 15. As strap 16 is fed through opening 42 the radial support brace 15 slides around the strap 16 and out of the way. Then the set pin 22 is pushed into the slot 21 furthest from end 19 of strap 16 (at its smallest diameter). The adjustable support brace according to this one embodiment of the invention is ready for shipping. The radial support braces 15 just slide around the outer ring 12 freely during shipping until the units are used. In the embodiment illustrated the radial support braces 15 can't be slid onto the outer ring 12 from the end 19 of strap 16 has a stop 19*a* is formed on the end 18 of strap 16. The stop 19*a* extends higher (approx. 3 mm) than the width of the strap 16 to stop the radial support braces 15 from sliding right off the end of the strap 16 when assembling.

Figure 29:
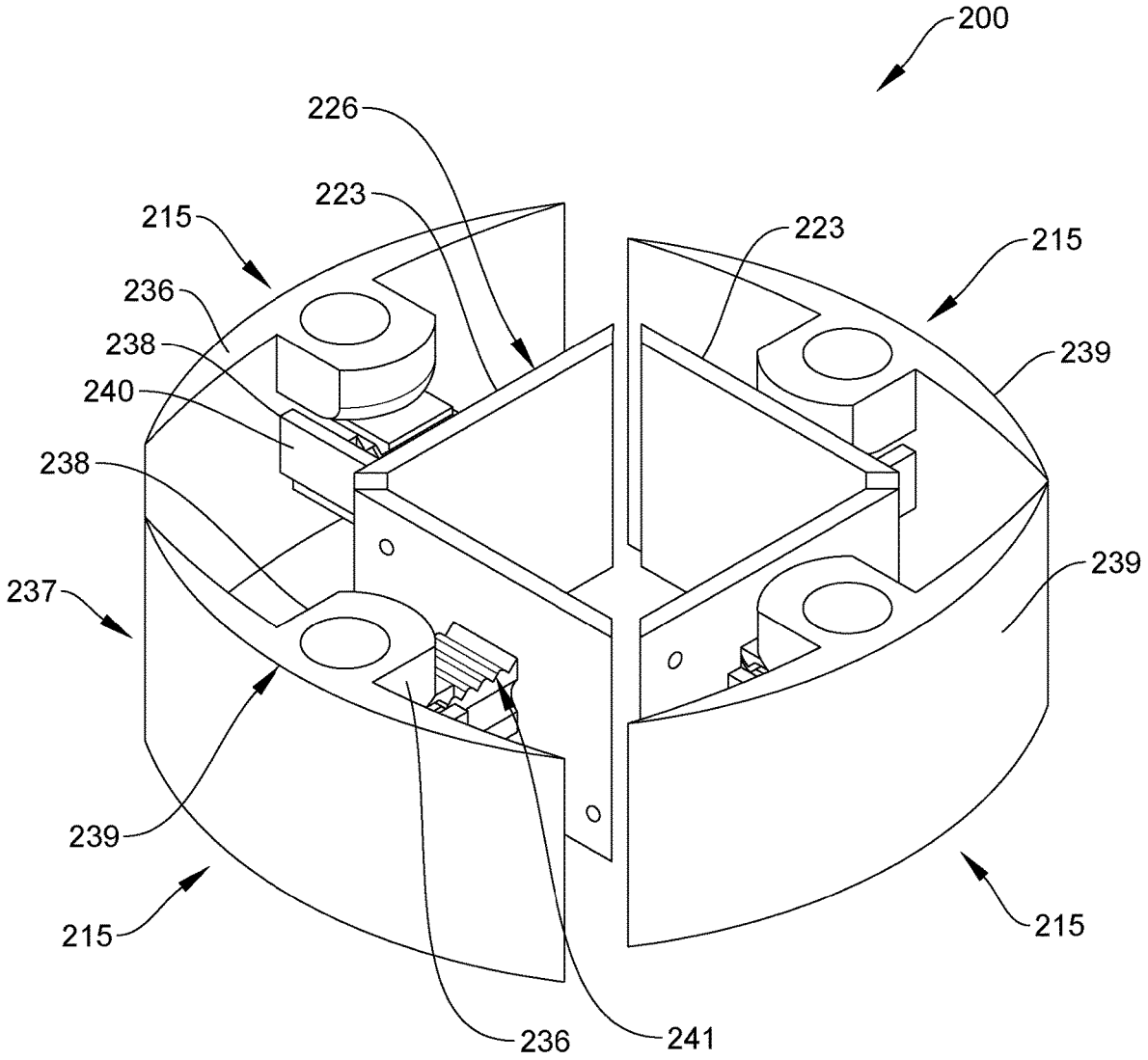
FIG. 29 is a perspective view of a third embodiment of a post support brace according to the present invention having a plurality of radial support braces with outer arced support sections.

Prior to the end 6 of the wooden post 1 being placed in the hole or excavation 3 with or without the use of a form 7, the pair of post support braces, generally indicated at 8, each post support brace formed from a plurality of the radial support braces 15 described above, are attached at spaced apart locations, 9, 10, on the portion 11 of the wooden post 1 that will be inserted into the hole 3. In the embodiment illustrated, a first end 25 of component 23 of each radial brace 15 is attached to wooden post 1 on each side of the wooden post 1 using fasteners through pilot holes 54 on each base plate 26. As shown in FIG. 29, spaced apart locations 9, 10 on the wooden post 1 for attachment of the post support braces 8*a*, 8*b* are recommended to be located at 25 to 30 cm up from the bottom of the hole 3 and 15 to 20 cm from the grade 4 in a downwardly direction. To make adjustments to a post's linear or lateral plumb placement in a cylindrical form 7 within a cylindrical hole 3 or within a cylindrical hole alone, onsite calculations are made to determine the level of adjustment knowing radial support braces 15 in the embodiment can adjust only so far (up to 1.25 inches in the embodiment illustrated) in directions lateral to the face or rear of the sides of posts and lateral in a linear direction in relation to the line of posts. Adjustments left, right, back, and forth may be achieved by free movement of the posts with the locking pin 45 of the radial support braces 15 in the unlocked position while in the hole. Once the desired location has been achieved with a face of the posts aligned with the plumb line and the post vertically plumb in both directions, the locking pins 45 are pushed/tapped into their locked position, thus securing the post by no longer allowing any movement of the radial support braces 15.

The support system described and illustrated enables an improved method of installing a wooden post having one end to be permanently encased by concrete, foam or other suitable aggregate in a cylindrical form within a cylindrical hole or in a cylindrical hole in the ground without the use of a form where the post is secured prior to and during the process of encasing the end of the wooden post. A benefit of the use of the present invention is the job site is kept clear of protruding braces above ground used in known methods that can pose a tripping hazard.

The method comprises the steps:

a. adjusting and locking the diameter of the circular adjustable outer ring 12 of a first adjustable post support brace 8*a* to the size of the cylindrical form 7 or cylindrical hole 3;

b. moving the radial support braces 15 along the circular outer ring 12 and attaching at location 10 on the wooden post 1, the first adjustable post support brace 8*a* adjacent to a lower end 6 of a wooden post 1 to be inserted into the form within a cylindrical form 7 or in the cylindrical hole 3 in the ground;

c. optionally locking the first component 23 of each radial support brace 15 in position relative to the second component 36 of the radial support brace 15;

d. adjusting and locking the diameter of the circular adjustable outer ring 12 of a second adjustable post support brace 8*b* to the size of the cylindrical form 7 or cylindrical excavation 3;

e. moving the radial support braces 15 along the circular outer ring 12 and attaching, at location 9, the second adjustable post support brace 8*b* to the portion 11 of the wooden post 1 to be inserted into the form 7 or in the cylindrical hole 3 in the ground, wherein the second adjustable post support brace 8*b* is spaced apart from the first adjustable post support brace 8*a;* f. optionally locking the first component 23 of each radial support brace 15 on the second adjustable post support 8*b* in position relative to the second component 36 of the radial support brace 15;

g. inserting the portion 11 of the wooden post 1 having the spaced apart adjustable post supports 8 into the form 7 or cylindrical excavation 3 in the ground;

h. if required to have the wooden post 1 in a desired linear, lateral, and plumb, vertical position, sequentially unlock (if required) the first component 23 of opposing radial support braces 15 of each spaced apart post support brace 8 and move the wooden post 1 to the desired position then lock the first component 23 of each of the opposing radial support braces 15 in position and repeat for the other set of radial support braces 15 so the wooden post 1 is secured prior to and during the process of encasing the portion 11 of the post in the form 7 or excavation in the ground 3 with concrete, foam or other suitable aggregate.

While the components that comprise the radial support braces 15 can be manufactured in the embodiment illustrated of HDPE (high density polyethlene), the components of the present inventions components can be manufactured from other materials.

Figure 28:
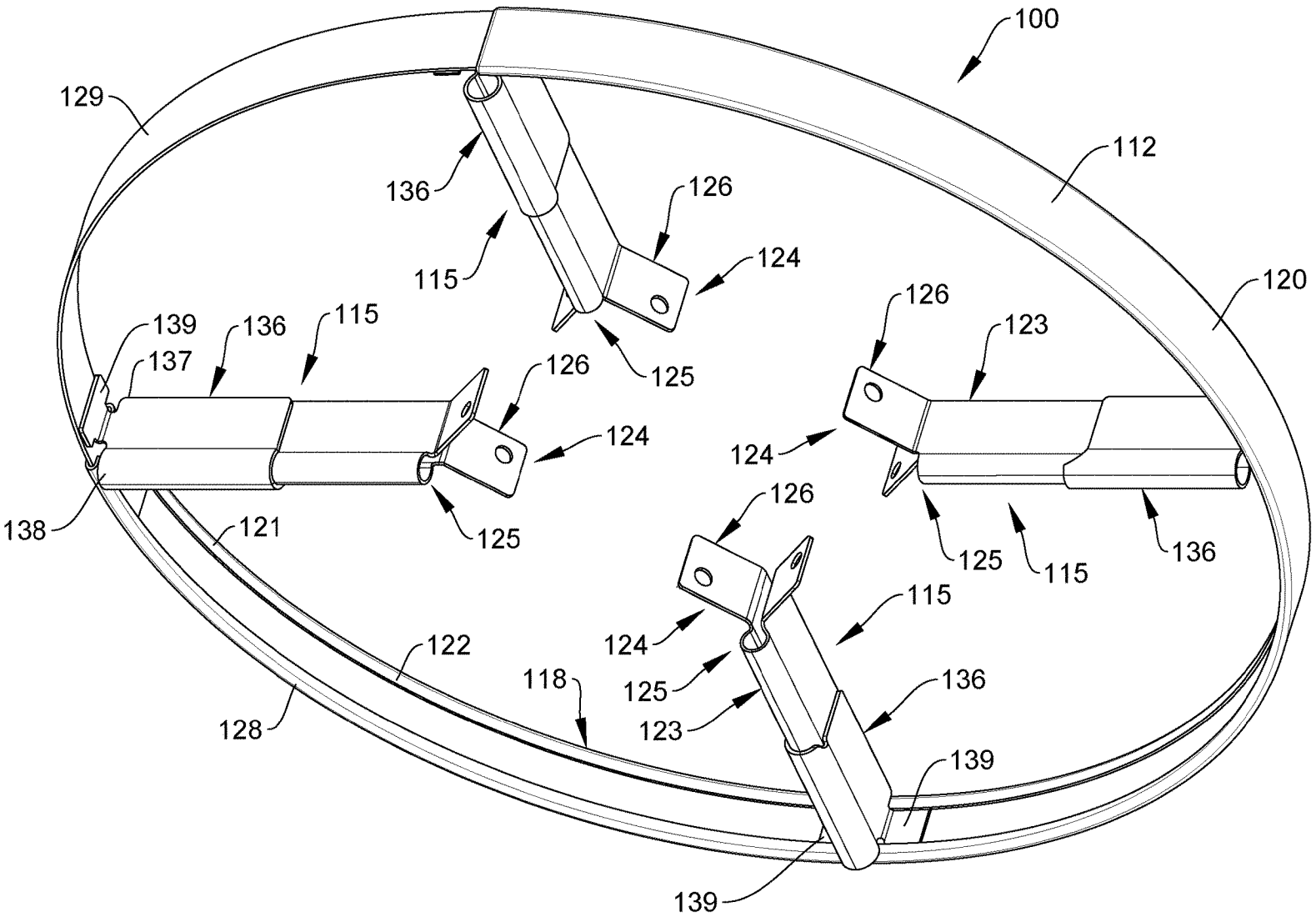
FIG. 28 is a perspective view of another embodiment of a post support brace according to the present invention having an outer ring and a plurality of radial support braces and outer ring.
Figure 28C:
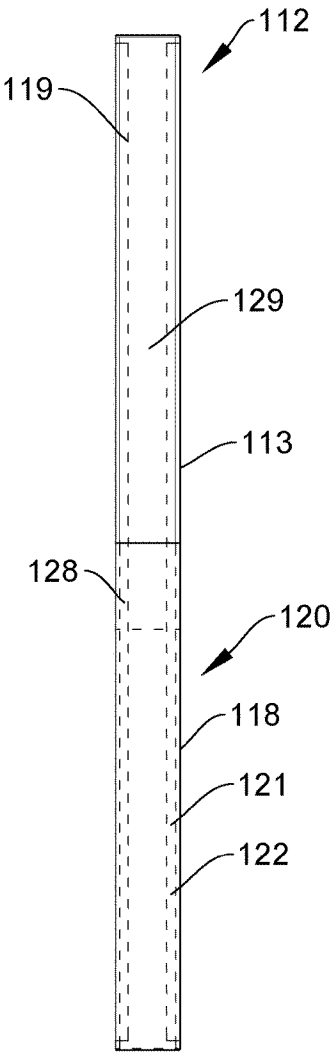
FIG. 28*c* is a left plan view of the outer ring of FIG. 28*b*.
Figure 28B:
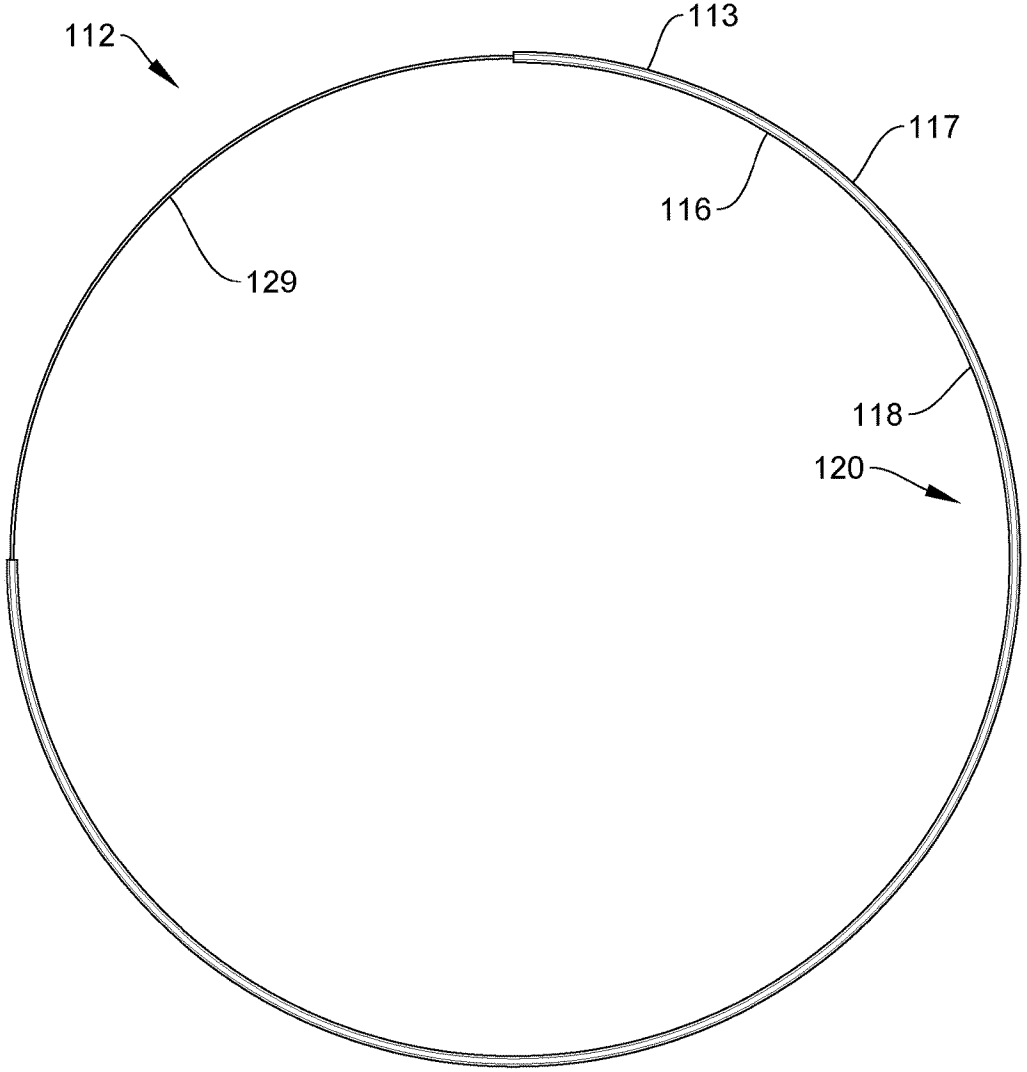
FIG. 28*b* is top plan view of the outer ring of FIG. 28.
Figure 28D:
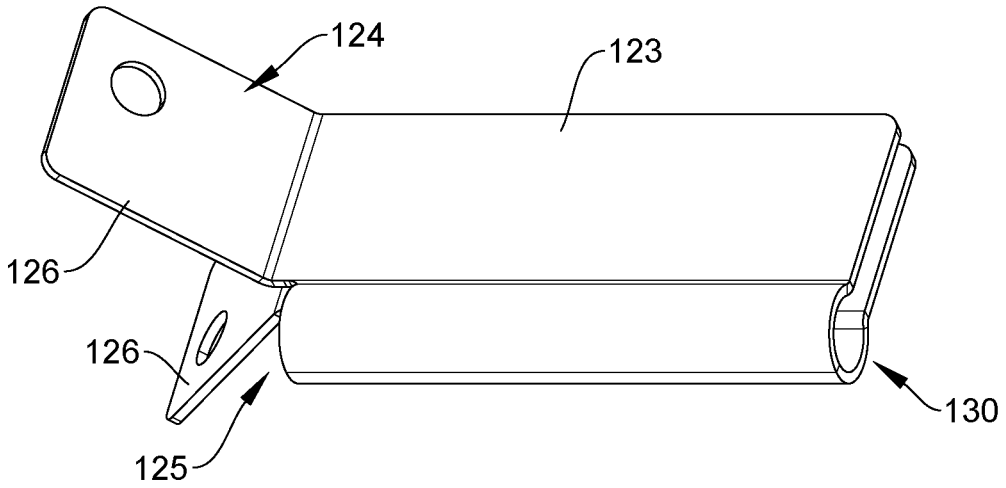
FIG. 28*d* is an enlarged perspective view of a first component of a radial support brace shown in FIG. 28.

Another embodiment of an adjustable support brace that can be utilized with the method of the present invention is illustrated in FIG. 28. The adjustable support brace, generally indicated at 100, is formed with a plurality of radial support braces, generally indicated at 115. In the embodiment illustrated in FIG. 2, 9-27 the plurality of radial braces, generally indicated at 115, each have a:

a. first component 123 that has:
   (i) a top and bottom surfaces, opposing sides and first and second ends;
   (ii) means 124 at a first end 125 of the body section to attach the first component 123 to a wooden post,
b. a second component 136 that has:
   (i) a a top surface, opposing sides and first and second ends;
   (ii) means 137 at a second end 138 of the second component 136 to support the second end 138 in abutment against a peripheral inner wall of the form or hole;
   (iii) means at a first end of the second component to cooperate with means at the second end of the first component to permit longitudinal movement of the first and second components;
c. means to lock the first component in position relative to the second component.

In the embodiment illustrated, first component 123 is "Y" shaped and has means, generally indicated at 124, at a first end 125 of component 123 to attach component 123 to the corners of a wooden post. In the embodiment illustrated means 124 is the pair of flanges 126 extending outwardly at 45° to the longitudinal axis of the first component 123.

Each of the plurality of radial support braces 115 in the embodiment illustrated in FIG. 28, further include a second component 136 that has means, generally indicated at 137, at a first end 138 of component 136 to attach component 136 to an outer ring 112. The outer ring 112, in the embodiment illustrated in FIG. 28, together with a pair of right angle flanges 139 provide the means 137 to support the first end 138 of second component 136 in abutment against a peripheral inner wall of the form or hole.

Outer ring 112 in the embodiment illustrated in FIG. 28 is a curved outer strap 113 having inner 116 and outer 117 surfaces and top 118 and bottom 119 longitudinal edges with a channel portion 120 having upper flanges 121 extending from the top edge 118 of said inner surface 116 to define a downwardly facing receiving channel 122 and lower flanges extending from the bottom edge of said inner surface to define an upwardly facing receiving channel. The downwardly facing receiving channel and opposing upwardly facing receiving channel extend along about 70% of the curved outer strap 113 and provide the curved outer strap 113 with a C-shaped cross section. The curved outer strap 113 has a tongue portion 129 defined by the section of the curved outer strap 113 without the downwardly facing receiving channel 122 and opposing upwardly facing receiving channel 128. The tongue portion 129 has inner and outer surfaces and top and bottom longitudinal edges, wherein the top and bottom longitudinal edges of the tongue portion are sized to slide in and out of the downwardly facing receiving channel 122 and opposing upwardly facing receiving channel 128 on the channel portion to form the circular outer ring 112. The diameter of the outer ring can be adjusted to accommodate a diameter from 9 inches to 12¾ inches for variably sized pre-manufactured cylindrical forms or equally shaped cylindrical excavations by pulling or pushing the tongue portion 129 in and out of the downwardly facing receiving channel 122 and opposing upwardly facing receiving channel 128 on the channel portion. Once the desired circumference is attained, means are provided to lock the tongue portion in position.

Each of the radial support braces 115 can be adjusted in length. The second end 130 of the first component 123 slides into the second component 136. The top surface and opposing sides of the second component 136 have an inverted U shaped cross section and the first component 123 is sized and shaped to slide within the second component to provide longitudinal movement of the first and second components. The design of the first and second components can be reversed so the second component slides within the first component.

Figure 28E:
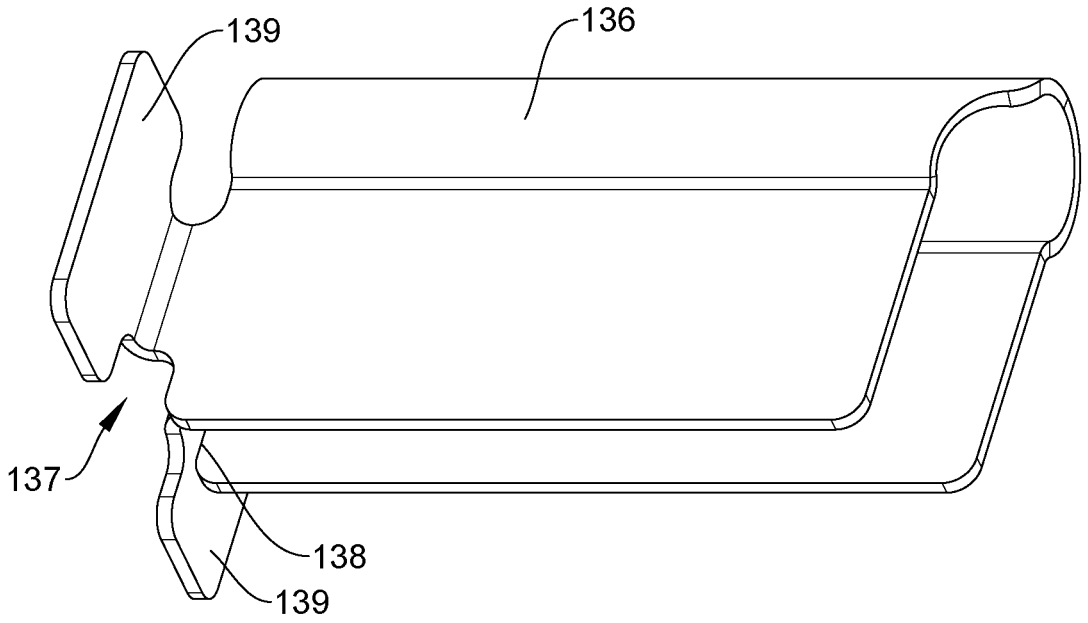
FIG. 28*e* is an enlarged perspective view of a second component of a radial support brace shown in FIG. 28.

In the embodiment illustrated in FIGS. 28-28*e* the radial support braces 115 and outer ring 112 are formed from galvanized steel and bent into shape.

Figure 30:
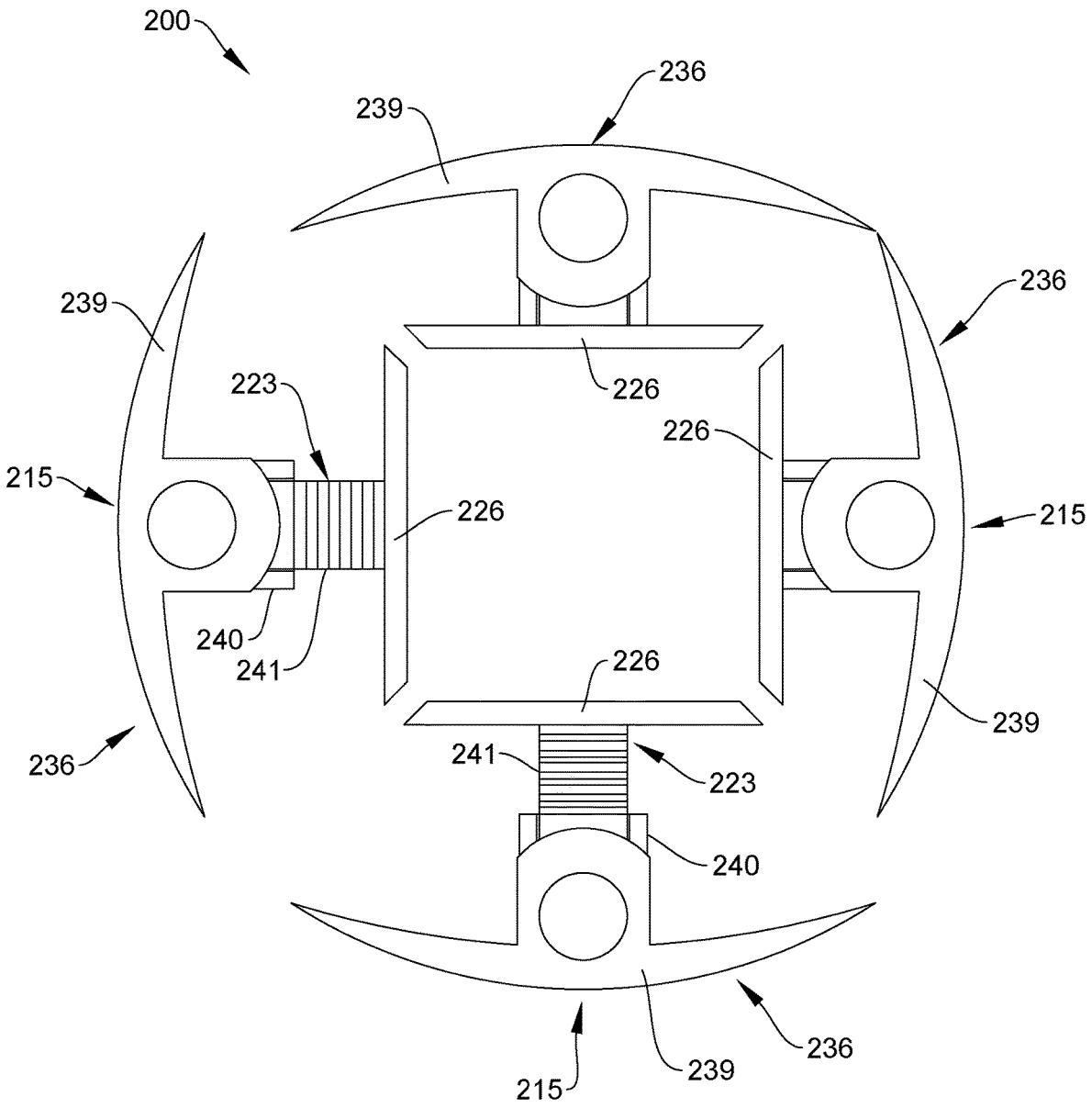
FIG. 30 is a top plan view of the post support brace of FIG. 29

Another embodiment of an adjustable support brace 200 is illustrated in FIGS. 29 and 30. In the embodiment illustrated the adjustable support brace, generally indicated at 200, is formed with a plurality of radial support braces, generally indicated at 215. The first component 223 has means, generally indicated at 224, at a first end 225 of component 223 to attach component 223 to sides of a wooden post. In the embodiment illustrated means 224 is a flange 226 perpendicular to the longitudinal axis of the first component 223.

Each of the plurality of radial support braces 215 in the embodiment illustrated in FIGS. 29 and 30, further include a second component 236 that has means, generally indicated at 237, at a first end 238 of component 236 to support the first end 238 of second component 236 in abutment against a peripheral inner wall of the form or hole.

In the embodiment illustrated in FIG. 29-30, means 237 to support the first end 238 of second component 236 in abutment against a peripheral inner wall of the form or hole is an arced flange 239. Extending radially from arced flange 239 is a body section 240 with an open end remote from arced flange 239. A second end 241 of the first component 223 is moveable within body section 240 on second component 236 allowing each of the radial support braces 215 to be adjusted in length.

While the principles of the invention have been shown and described in connection with specific embodiments, it is to be understood that such embodiments are by way of example and are not limiting as is evident from the foregoing description, certain aspects of the present invention are not limited by the particular details illustrated in the drawings. Other modifications and applications, or equivalents, will occur to those skilled in the art. The terms "having", "comprising" and "including" and similar terms as used in the foregoing specification are used in the sense of "optional" or "may include" and not as "required". Many changes, modifications, variations and other uses and applications of the present construction will, however, become apparent to those skilled in the art after considering the specification and attached drawings. All such changes, modifications, variations and other uses and applications which do not depart from the spirit and scope of the invention are deemed to be covered by the invention which is limited only by the claims that follow. The scope of the disclosure is not intended to be limited to the embodiments shown herein, but is to be accorded the full scope consistent with the claims, wherein reference to an element in the singular is not intended to mean "one and only one" unless specifically so stated, but rather one or more. All structural and functional equivalents to the elements of the embodiment described throughout the disclosure that are known or later come to be known to those of ordinary skill in the art are expressly incorporated herein by reference and intended to be encompassed by the claims.

The embodiments of the invention in which an exclusive property or privilege is claimed are defined as follows:

1. A radial support brace for use with a support system for a wooden post having one end to be permanently encased by concrete, foam or other aggregate in a cylindrical form within a cylindrical hole or in a cylindrical hole in the ground without the use of a form, the radial support brace comprising a. a first component that has
   (i) a body section having top and bottom surfaces, opposing sides and first and second ends;
   (ii) means at the first end of the body section to attach the first component to the wooden post, b. a second component that has
   (i) a first section having a top surface, opposing sides and first and second ends;
   (ii) means at the second end of the first section to support the second end of the first section in abutment against a peripheral inner wall of the cylindrical form or the cylindrical hole in the ground without the use of a form;
   (iii) means at the first end of the first section to cooperate with means at the second end of the first component to permit longitudinal movement of the first and second components;

c. means to lock the first component in position relative to the second component, wherein the second end of the first section has an opening sized and shaped to permit a circular outer ring to pass through said opening and permit an adjustable support brace to move around said circular outer ring while extending radially inwardly from the circular outer ring.

2. A radial support brace in accordance with claim 1, wherein the means to attach the first component to the wooden post is a base plate perpendicular to a longitudinal axis of the first component adapted for connection to a side of the wooden post.

3. A radial support brace in accordance with claim 1, wherein the circular outer ring is sized and shaped so that it can be adjusted to accommodate variably sized pre-manufactured cylindrical forms or equally shaped cylindrical excavations.

4. A radial support brace in accordance with claim 1, wherein the circular outer ring is formed from a strap having inner and outer surfaces, top and bottom longitudinal edges, a first end and a second end which wraps around itself and having means to adjust a diameter of the circular outer ring.

5. A radial support brace in accordance with claim 4, wherein the means to adjust the diameter of the circular outer ring are a plurality of slots traverse to a longitudinal axis of the strap sized and shaped to accept a set pin formed on an end of the strap.

6. A radial support brace in accordance with claim 1, wherein a rod section extends from the first end of the first section of the second component and is sized and shaped to fit within a longitudinal channel in the second end of the first component to permit longitudinal movement of the first and second components.

7. A radial support brace in accordance with claim 6, wherein a vertical slot extends downwardly from the top surface of the body section of the first component and open on the opposing sides of the body section.

8. A radial support brace in accordance with claim 7, wherein the means to lock the first component in position relative to the second component comprises a locking pin extends through the vertical slot in the body section of the first component, the locking pin sized and shaped to lock the first component in position relative to the second component.

9. A radial support brace in accordance with claim 8, wherein the locking pin has a pair of end plates connected by a rod, the rod having top and bottom surfaces, the rod sized and shaped to slide perpendicularly to a longitudinal axis of the first component within the vertical slot in the body section of the first component beneath the rod section extending from a first end of the first section of the second component within the longitudinal channel in the second end of the first component, a top surface of the locking pin tapered so that when the locking pin is pushed from an unlocked position to a locked position the rod section extending from the first end of the first section of the second component is locked in position against walls of the longitudinal channel in the second end of the first component.

10. A support system for a wooden post comprising a plurality of spaced apart adjustable post support braces formed from a plurality of radial support braces comprising:

a. a first component that has
   (i) a body section having top and bottom surfaces, opposing sides and first and second ends;
   (ii) means at the first end of the body section to attach the first component to the wooden post, b. a second component that has
   (i) a first section having a top surface, opposing sides and first and second ends;
   (ii) means at the second end of the first section to support the second end of the first section in abutment against a peripheral inner wall of a form or hole;
   (iii) means at the first end of the first section to cooperate with means at the second end of the first component to permit longitudinal movement of the first and second components;

c. means to lock the first component in position relative to the second component, wherein the second end of the first section has an opening that is sized and shaped to permit a circular outer ring to pass through said opening and permit said an adjustable support brace to move around said circular outer ring while extending radially inwardly from the circular outer ring.

11. A radial support brace for use with a support system for a wooden post having one end to be permanently encased by concrete, foam or other aggregate in a cylindrical form within a cylindrical hole or in a cylindrical hole in the ground without the use of a form, the radial support brace comprising a. a first component that has
   (i) a body section having top and bottom surfaces, opposing sides and first and second ends;

(ii) means at the first end of the body section to attach the first component to the wooden post, b. a second component that has (i) a first section having a top surface, opposing sides and first and second ends;

(ii) means at the second end of the first section to support the second end of the first section in abutment against a peripheral inner wall of the cylindrical form or the cylindrical hole in the ground without the use of a form;

(iii) means at the first end of the first section to cooperate with means at the second end of the first component to permit longitudinal movement of the first and second components;

c. means to lock the first component in position relative to the second component, wherein a rod section extends from the first end of the first section of the second component and is sized and shaped to fit within a longitudinal channel in the second end of the first component to permit longitudinal movement of the first and second components, and wherein a vertical slot extends downwardly from the top surface of the body section of the first component and open on the opposing sides of the body section.

* * * * *